US007270131B2

(12) United States Patent
Hocking et al.

(10) Patent No.: US 7,270,131 B2
(45) Date of Patent: Sep. 18, 2007

(54) HARD SURFACE CLEANING COMPOSITION

(76) Inventors: Edward Hocking, P.O. Box 2121, Rancho Santa Fe, CA (US) 92067; Dimas Reyes, 726 Lynnplace, El. Cajon, CA (US) 92020

( * ) Notice: Subject to any disclaimer, the term of this patent is extended or adjusted under 35 U.S.C. 154(b) by 0 days.

(21) Appl. No.: 11/220,510

(22) Filed: Sep. 6, 2005

(65) Prior Publication Data

US 2007/0054832 A1 Mar. 8, 2007

(51) Int. Cl.

| | |
|---|---|
| ***B08B 3/04*** | (2006.01) |
| ***C11D 1/70*** | (2006.01) |
| ***C11D 3/02*** | (2006.01) |
| ***C11D 3/37*** | (2006.01) |
| ***C11D 3/43*** | (2006.01) |

(52) U.S. Cl. ..... 134/25.2; 134/25.3; 134/39; 134/40; 134/42; 510/238; 510/421; 510/432; 510/475; 510/476

(58) Field of Classification Search ..... 510/109, 510/461, 238, 421, 432, 475, 476; 134/25.2, 134/25.3, 39, 40, 42

See application file for complete search history.

(56) References Cited

U.S. PATENT DOCUMENTS

| | | | | |
|---|---|---|---|---|
| 3,308,068 A | | 3/1967 | Jones | |
| 3,725,290 A | * | 4/1973 | Nelson | 510/479 |
| 3,741,902 A | * | 6/1973 | Barrett, Jr. | 510/283 |
| 4,257,907 A | | 3/1981 | Langguth et al. | |
| 4,351,754 A | * | 9/1982 | Dupre | 524/445 |
| 4,423,199 A | | 12/1983 | Chang et al. | |
| 4,597,889 A | * | 7/1986 | Jones et al. | 510/337 |
| 4,867,896 A | * | 9/1989 | Elliott et al. | 510/223 |
| 4,968,735 A | * | 11/1990 | Page et al. | 524/55 |
| 5,380,447 A | * | 1/1995 | Kirk et al. | 510/276 |
| 5,629,365 A | * | 5/1997 | Razavi | 524/37 |
| 5,677,101 A | * | 10/1997 | Noguchi et al. | 430/166 |
| 5,929,024 A | * | 7/1999 | Stringer et al. | 510/504 |
| 6,297,336 B1 | | 10/2001 | Shinji et al. | |
| 6,635,702 B1 | | 10/2003 | Schmucker-Castner et al. | |

FOREIGN PATENT DOCUMENTS

| | | |
|---|---|---|
| CA | 623617 | 7/1961 |
| GB | 870994 | 6/1961 |

* cited by examiner

*Primary Examiner*—Brian Mruk
(74) *Attorney, Agent, or Firm*—Gordon & Rees LLP

(57) ABSTRACT

Aqueous hard surface cleaning compositions comprising a non associative, acrylic copolymer alkali swellable emulsion and a set of alkaline detergent builders. Methods of producing the compositions, using the compositions for cleaning hard surfaces, and improving the cleaning efficiency of alkaline liquid cleaning compositions.

4 Claims, No Drawings

HARD SURFACE CLEANING COMPOSITION

FIELD OF THE INVENTION

The invention relates to aqueous, alkaline, hard-surface cleaning compositions. More particularly, the compositions contain a source of alkalinity, a surfactant, and a non-associative copolymer acrylate emulsion.

BACKGROUND/RELATED ART

The most important factor in designing the right cleaner is to identify the main soil component(s) and select agents which optimize cleaning efficiency for those soils.

Most floor dirt and grime is removed with strong compositions having high alkaline (caustic) or high solvent content. Even strong chemicals often have to dwell 10-15 minutes to cut through the dirt and grime. During this period, settling followed by a reattachment of some of the dirt and grime will occur. When the floor is rinsed with water these redeposits especially on porous material, result in a marginally clean floor with a flat finish. So the process is repeated to gain the desired cleanliness and then most often followed by a coat of wax to establish the finish. Not only does this require a labor intensive three step process (at least), multiple applications of strong chemicals, damaging the floor thereby reducing its useful life. The strong chemicals require proper hazardous material handling, so the building owner incurs both recurring (labor and haz mat)) and non-recurring (shortened floor life) costs.

When the wash solution contacts a soiled surface, it is intended that it successfully removes the soil from the article. Such detergency (soil removal) is most commonly obtained from a source of alkalinity used in manufacturing the detergent.

In the cleaning of hard surfaces, the constituent materials of the surfaces to be cleaned and the nature and intensity of the soil have to be taken into account besides hygienic and aesthetic aspects. Hard surfaces include, for example, coverings of natural stones, tiles, such as fine stoneware tiles, and also elastic coverings, such as linoleum and PVC. In the institutional cleaning of hard surfaces, another factor to be taken into consideration is that the surfaces have different textures and, at the same time, different types of soil have to be removed, optionally with simultaneous disinfection depending on the particular application. For these reasons, various compositions have also been developed for this sector.

In practice, the choice of composition is largely determined by whether the composition performs the cleaning function on the various materials in a short time without harming them, irrespective of the type of soil. For economic reasons, machines are used for this purpose in institutional cleaning. Vacuum scrubbing machines (automatic cleaners) and scrubbing machines (single-disk or contr-arotating multiple-disk machines or brush cylinder machines) are generally used for cleaning floors. In the latter case, the cleaning composition is removed by suction in a second operation carried out with a so-called wet vacuum cleaner.

In the cleaning of floors with rough surfaces, the dirt settles very quickly on such floors because of their large surface. If cleaning compositions only are used, the surfaces become heavily soiled after only a very short time. In order to delay the redeposition of soil, cleaning is generally carried out in two steps, namely the cleaning step as such and subsequent surface protection of the floor covering. Products which contain both cleaning and floor care ingredients do not show adequate cleaning performance so that there is a continuous buildup of dirt.

A substantial need exists in improving the properties of alkali detergent systems. In improving such systems, the cleaning properties of the systems are examined for the purpose of obtaining sufficient cleaning of all types of soils including inorganic soils, food soils such as fats, carbohydrates and proteins and organic soils obtained from the environment such as hydrocarbon oils, pigments, and carbonized soil from food sources that have been attached to food cooking surfaces and other adjacent surfaces in food preparation areas. Typically, this soil attaches itself when temperatures rise above 150° F. causing the soil to become "baked on" and carbonized. Another type "soil" which is difficult to clean from hard floor surfaces are scuff marks and heel marks caused by foot traffic.

Accordingly, the problem addressed by the present invention was to improve conventional alkali hard floor liquid cleaning compositions and, at the same time, to develop cleaning compositions for hard surfaces, particularly for the institutional sector, which would show good cleaning performance and, at the same time, would preserve the surface so that cleaning could be carried out in a single, safe operation.

SUMMARY

The present invention provides aqueous hard surface cleaning compositions which comprise nonassociative, acrylic copolymer alkali swellable emulsion and a set of alkaline detergent builders. Alkaline sources of the composition are selected from alkaline detergent builders such as sodium hydroxide, potassium hydroxide, sodium carbonate, potassium carbonate, sodium borate, potassium borate, or mixtures thereof. Certain embodiments further comprise condensed phosphate selected from one or more of the group consisting of sodium orthophosphate, potassium orthophosphate, sodium pyrophosphate, potassium pyrophosphate, sodium tripolyphosphate, sodium hexametaphosphate, or mixtures thereof. The compositions in another embodiment further comprise a non-ionic surfactant.

The invention involves methods for cleaning a hard surface which involve the step of contacting a hard surface with the aqueous hard surface cleaning compositions of the invention, and rinsing the composition from the surface. Variations of this cleaning method involve forming use solutions of the composition by dilution. A method is provided for forming dilute use solutions of the composition.

A method of producing the compositions is disclosed, which involves combining a set of alkali detergent builders and a non-associative, acrylic copolymer, alkali swellable emulsions. A composition formed by this method is also provided.

Another aspect of the involves a method of improving the cleaning efficiency of a alkalai liquid cleaning compositions which involves the steps of blending non-associative, acrylic copolymer, alkali swellable emulsions with a base alkaline cleaning composition.

DETAILED DESCRIPTION

The present invention is directed to a water-based, alkali hard surface cleaning composition with a pH above 7 for cleaning hard surfaces, characterized in that it contains a blend of alkali sources, sequestrants, nonionic surfactant (detergent), and non-associative acrylic copolymer alkali swellable emulsion (NACOPASE). The cleaning composition is used primarily for industrial flooring such as found in airports, sports stadiums, schools, automotive and/or transportation maintenance facilities, food service, convention centers, hotels, and hospitals.

It has been found that the addition of a NACOPASE to a conventional alkali detergent composition of alkali sources and nonionic surfactant provides the conventional alkali detergent composition with substantially improved soil removal activity. Accordingly, when a NACOPASE is combined with alkali builders, an advantageous liquid cleaning composition is obtained. The NACOPASE improved the cleaning performance of a nonionic surfactant based alkali detergent, permitting greater removal of soil.

The compositions according to the invention are preferably diluted with water for use (i.e. use solutions), the concentration in which they are applied generally being between 1% and 20% by weight, and preferably between 5% and 15%, basedd on the solution. The use solutions may be applied manually or by conventional automatic cleaners, for example by applying the cleaning solution and machine-scrubbing the floor with vacuum or other scrubbing machines. The partly dissolved soil is thoroughly dispersed in the cleaning solution so that it is not redeposited in the pores of the floor material before the solution is removed by rinsing, vaccuming, or other means of mechanical agitation.

Types of soil that can be cleaned from hard surfaces according to the invention include those types of soils that are commonly encountered on concrete, brick, stone, porcelain, grout, paint, linoleum, hard metals, soft metals, plastics, wood, epoxy flooring. Common types of soil that can be cleaned according to the invention include grease soils, carbon particulate soils, body fluid soils, and sand and/or dirt soils. An exemplary grease soil includes oil lubricant. Exemplary carbon particulate soils include soils resulting from welding and/or from fires. Exemplary body fluid soils include sweat, perspiration, and urine.

The cleaning composition according to the invention is distinguished in particular by the fact that it removes a broad spectrum of oily and pigment-containing soil types. The cleaning composition according to the invention matches or exceeds the cleaning performance of particularly detersive anionic cleaning compositions.

The cleaning compositions according to the invention may be formulated as liquid products, or as concentrates, pastes, gels, powders, or granulated formulas, the transitions between these products being fluid as well-known to the expert. Normal products are generally liquid and represent solutions of their ingredients. The so-called concentrates are solutions or emulsions of the ingredients and have a liquid to thickly liquid consistency.

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

A "cleaning composition for hard surfaces" as used herein refers to cleaning or detergent compositions for solid surfaces which are specialized and designed for, or peculiar to, use in cleaning or removing foreign matter from solid surfaces.

Alkaline Detergents

Alkaline detergents are water-soluble alkalis having detergent properties. The usual range in pH is from 9 to 14. Alkali detergents are used in applications where a strong detergent is required such as removing water emulsion waxes, scuff marks and heavy accumulations of dirt. Generally, alkali detergents are used for "hard surface" cleaning. High alkalinity is important in neutralizing acids found in many types of dirt. They are the most used of all cleaning materials. Alkaline detergents remove a wider range of dirt and soil than any other type of detergent.

Detergency

Detergency is the removal of soil (matter out of place) from a substrate immersed in some medium, generally through the application of a mechanical force, in the presence of a chemical substance which may lower the adhesion of the soil to the substrate. The process is completed when the soil is maintained in suspension so that it can be rinsed away.

Active Ingredients of Alkali Detergents

An alkaline detergent composition include a source of alkalinity and effective amounts of a surfactant detergent and agents for chelating or sequestering divalent cations ($Mg^{++}$ $Ca^{++}$). Additional detergency can be obtained from the use of surfactant materials. Typically, nonionic surfactants are formulated into such detergents with other ingredients to obtain compositions that can be used to form cleaning solutions having substantial detergency. A number of optional detergent ingredients can enhance soil removal, but primarily soil removal is obtained from the alkalinity source and the nonionic surfactant.

Detergent Builders

As used herein, the term "detergency builder" refers to an agent that serves to enhance the cleaning capacity or cleansing action of detergent compounds in a cleaning composition. A detergency builder has the property of improving detergency levels in detergent compositions. Such cleaning boosters are called "builders." "Builders" permit the attainment of cleaning performance which is superior to an "unbuilt" composition.

In principle, the builder present in the hard surface cleaning compositions according to the invention may be any substance known from the prior art as a builder suitable in the broadest sense for alkali cleaning compositions.

The alkali cleaning compositions of the invention may optionally contain builders in a quantity of up to 60% by weight and preferably in a quantity of 15 to 40% by weight.

Suitable sequestrant builders are, for example, alkali metal phosphates which may be present in the form of their sodium or potassium salts. Examples include tetrasodium diphosphate, pentasodium triphosphate, so-called sodium hexametaphosphate and the corresponding potassium salts or any mixtures of thereof.

Complexing agents, for example nitrilotriacetate or ethylenediamine tetraacetate, may also be used. Soda ash and borax are also builders in the context of the present invention.

Alkaline Builders

Highly alkaline detergents (or heavy-duty detergents) use caustic soda (sodium hydroxide) or caustic potash (potassium hydroxide). Moderately alkaline detergents include sodium, potassium, or ammonium salts of phosphates, silicates, or carbonates. Tri-sodium phosphate (TSP) is one of the oldest and most effective. Silicates are most often used as a corrosion inhibitor Sequestering Agents A sequestering agent is a chemical whose molecular structure can envelop and hold a certain type of ion in a stable and soluble complex. Divalent cations, such as hardness ions, form stable and soluble complex structures with several types of sequestering chemicals. When held inside the complex, the ions have a limited ability or are unable to react with other ions, clays or polymers. Ethylenediamine tetraacetic acid (EDTA) is a well-known sequestering agent for the hardness ions, such as Ca+2. Polyphosphates can also sequester hardness ions. A synonym for a sequestering agent is "chelation" agent.

The composition may include a chelating/sequestering agent such as EDTA. In general, a chelating agent is a molecule capable of coordinating (i.e., binding) the divalent metal ions commonly found in natural water to prevent the metal ions from interfering with the action of the other detersive ingredients of a cleaning composition.

The chelating/sequestering agent may also function as a threshold agent when included in an effective amount. Preferably, a cleaning composition includes about 0.5 wt-%, preferably from about 5 wt-%, of a chelating/sequestering agent. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Alkali Detergent Builders—Phosphates

The most common builder of alkaline detergents is trisodium phosphate (TSP), which is banned in many states and under regulation/control and monitoring by the Environmental Protection Agency. TSP is a strong base-type powdered cleaning material sold under various brand names. Other chemical or common names include Sodium Orthophosphate; Tribasic sodium phosphate; Trisodium orthophosphate; TSP; Phosphate of soda; (also sold under brand names such as Red Devil®, Red Devil, Inc., Union, N.J.).

Sodium hydroxide (NaOH) is also known by other other chemical or common names including caustic soda*; hydrate of soda; hydrated oxide of sodium; lye; mineral alkali; soda lye; sodic hydrate; sodium hydrate.

Sodium pyrophosphate, tetrasodium pyrophosphate—a sodium salt of pyrophosphoric acid are used as builders in soaps and detergents. Sodium tripolyphosphate, which is a sodium salt of triphosphoric acid, is also used as a builder in detergents, as well as tribasic sodium phosphate, trisodium orthophosphate, trisodium phosphate, the tertiary phosphates of sodium.

In these applications, the most common inorganic sequestering agent comprises a condensed phosphate hardness sequestering agent such as tripolyphosphate, hexametaphosphate, pyrophosphate and other such phosphate materials.

Certain disadvantages and shortcomings are recognized with known builder compounds. Perhaps the most widely acknowledged limitation regards the series of condensed inorganic polyphosphate compounds such as alkali metal tripolyphosphates and higher condensed phosphates. These compounds, which constitute the most widely commercially used builders when used in detergent compositions have a strong tendency to hydrolyze into less condensed phosphorus compounds which are relatively inferior builders and, which may, in fact, form undesirable precipitates in aqueous washing solutions.

Alkaline Sources. Sources of alkalinity can include alkali metal hydroxides, alkali metal silicates, alkali metal carbonates and other typically inorganic based materials. Potassium hydroxide (KOH) is known under other chemical or common names including potassium hydrate; caustic potash; caustic potassium; hydrate of potassium. Ammonium hydroxide or ammonia (NH4OH) is known under other chemical or common names including ammonia water; aqua ammonia; household ammonia.

The cleaning composition produced according to the invention may include minor but effective amounts of one or more alkaline sources to enhance cleaning of a substrate and improve soil removal performance of the composition.

Accordingly, an alkali metal hydroxide or an alkali metal carbonate or other alkaline source is preferably included as a primary alkaline source in the cleaning composition in an amount effective to provide the desired level of cleaning action.

It is preferred that the composition comprises about 0.5 to about 10 wt-%, preferably between 5 and 8 wt-% of an alkaline source. The cleaning capacity can be augmented with a second source of alkalinity. These percentages and others in the specification and claims are based on the actual active materials used. These composition materials are added as aqueous or other materials with an active content of (e.g.) 20% to 100% of the material.

For the purpose of this application, the alkalinity source can comprise a carbonate base source of alkalinity. Such an alkalinity source can comprise an alkali metal carbonate augmented by other caustic or basic materials. Typical carbonates include sodium carbonate ($Na_2.CO_3$.), potassium carbonate ($K_2.CO_3$) or other typical carbonate sources. Such carbonates can contain as an impurity some proportion of bicarbonate ($HCO_3$.). Such a carbonate source of alkalinity can be augmented using a variety of other inorganic sources of alkalinity or inorganic bases.

Suitable alkali metal hydroxides include, for example, sodium or potassium hydroxide. An alkali metal hydroxide may be added to the composition in the form of solid beads, dissolved in an aqueous solution, or a combination thereof. Secondary alkalinity agents are commonly available in either aqueous or powdered form, either of which is useful in formulating the present cleaning compositions. The composition may include a secondary alkaline source in an amount of about 0.5% to about 5%.

Surfactant Detergents

The term "surfactant" or "surface active agent" refers to an organic chemical that when added to a liquid changes the properties of that liquid at a surface.

An embodiment of the compositions of the inventions incorporates Tergitol NP-9® (Dow Chemical co., Midland, Mich.), which is a nonionic, nonylphenol ethoxylate surfactant. Other embodiments are contemplated wherein the non-ionic surfactant may be one or more of: Tergitol NP-33 [9016-45-9] Synonyms: alpha(nonylphenyl)-omega-hydroxypoly(oxy-1,2-ethanediyl); antarox; Nonylphenoxypoly(ethyleneoxy)ethanol; nonylphenyl polyethyleneglycol ether, nonionic; nonylphenyl polyethylene glycol ether; PEG-9 nonyl phenyl ether; POE (10) nonylphenol; POE (14) nonylphenol; POE (1.5) nonyl phenol; POE(15) Nonyl Phenyl Ether; POE(18) Nonyl Phenyl Ether; POE (20) nonylphenol; POE(20) Nonyl Phenyl Ether; POE (30) nonylphenol; POE (4) nonylphenol; POE (5) nonylphenol; POE (6) nonylphenol; POE (8) nonylphenol; polyethylene glycol 450 nonyl phenyl ether; polyethylene glycol 450 nonyl phenyl ether, nonionic surfactant; polyethylene glycols mono(nonylphenyl)ether; Polyethylene Mono(nonylphenyl) ether Glycols; polyoxyethylene (10) nonylphenol; polyoxyethylene (14) nonylphenol; polyoxyethylene (1.5) nonyl phenol; polyoxyethylene (20) nonylphenol; polyoxyethylene (30) nonylphenol; polyoxyethylene (4) nonylphenol; polyoxyethylene (5) nonylphenol; polyoxyethylene (6) nonylphenol; polyoxyethylene (8) nonylphenol; Polyoxyethylene (9) Nonylphenyl Ether; polyoxyethylene(n)-nonylphenyl ether; Polyoxyethylene nonylphenol; polytergent b; POE nonylphenol; protachem 630; renex 600's; rewpol hv-9; solar np; sterox; surfionic n; T-DET-N; tergitol np; Tergitol NP-14; Tergitol NP-27; Tergitol NP-33; Tergitol NP-35; Tergitol NP-40; Tergitol npx; Tergitol TP-9; tergitol tp-9 (non-ionic); triton n; antarox bl-344; arkopal N-090; carsonon N-9; conco ni; conco ni-90; dowfax 9n; Ethoxylated nonylphenol; Glycols, polyethylene, mono(nonylphenyl) ether; igepal co; igepal co-630; macrogol nonylphenyl ether; Makon; neutronyx 600; neutronyx 600's; nonipol no; nonoxinol; nonoxynol; Nonoxynol-15; Nonoxynol-18; Nonoxynol-20; nonyl phenol ethoxylate; Nonylphenol polyethylene glycol ether; Nonylphenol, polyoxyethylene ether; nonylphenoxypolyethoxyethanol;

The detergent composition preferably includes an amount of non-ionic surfactant that provides a desired level of cleaning.

Preferably, the amount of non-ionic surfactant provided in the detergent composition concentrate is between about 1 wt. % and about 20 wt. %, and more preferably between 2 wt. % and 16 wt. %, and, even more preferably, between 4 wt. % and 15 wt. %.

The composition can comprise at least one cleaning agent which is preferably a surfactant or surfactant system. Preferable surfactants in the compositions of this invention are non-ionic surfactants, which are available from a number of sources. For a discussion of surfactants, see Kirk-Othmer, Encyclopedia of Chemical Technology, Third Edition, volume 8, pages 900-912. Preferably, the hard surface cleaning composition comprises a nonionic-cleaning agent in an amount effective to provide a desired level of cleaning, preferably about 0-20 wt-%, more preferably about 1.5-15 wt-%.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants comprising a hydrophobic silicone group and a hydrophilic group such as ABIL B8852 can also be used.

The alkyline oxide part of the surfactant molecule is usually ethylene oxide but can also be propylene oxide. The number of ethylene oxide units incorporated in the molecule determines whether the material will be water insoluble (oil soluble), dispersible, or soluble in water.

The more ethylene oxide units the greater the water solubility of the surfactant molecule.

Nonassociative, Acrylic, Copolymer, Alkali-Soluble, Swellable Emulsion—NACOPASE

It has now been discovered that NACOPASE possess extraordinary builder properties capable of enhancing or boosting the detergency levels of alkaline detergent builders, superior to a sodium triphosphate built liquid product.

Embodiments of the hard surface cleaning compositions of the invention are formulated with a nonassociative, acrylic, copolymer, alkali-soluble, swellable emulsion, which herein is given the acronym NACOPASE.

Water-soluble, acrylic copolymer swellable emulsions are known functionally as thickeners. Thickeners are either associative or nonassociative types. "Nonassociative thickeners" are water soluble or water swellable polymers that do not have chemically attached hydrophobic groups. Nonassociative thickeners are for waterborne systems, interacting with the aqueous phase. Non-associative rheology modifiers do not interact with surfactant structures, particulates, or insoluble emulsion droplets. These polymers interact with themselves. They have excellent compatibility with nonionic surfactants. In general, the non-associative anionic polymer is more suitable for mild formulations with low electrolyte content. (Martin & Merkle, Ciba Specilaity Monograph). Conventional non-associative alkali-soluble polymers contain substantially lack hydrophobic macromonomers in their backbone.

The suitable NACOPASEs for use according to the present invention are not selected based on their known properties to control viscosity of the composition, prior to application.

The NACOPASEs for use in the present invention are cross-linked alkali swellable emulsions based on acrylic acid derivatives. By adjusting the pH to above 7, the carboxylic groups are ionized and a negative charge is built up along the polymer backbone. The electrostatic repulsion of the carboxyl-anion charge centers, in close proximity to one another, leads to the swelling and entanglement of the polymer chains. The neutralization of the acid functions, followed by the elongation of the polymer chains, solubilize the polymer, resulting in a transparent formulation.

It should be understood that the NACOPASE of the present invention are not associative thickeners. Associative thickeners are water soluble or water swellable polymers that have chemically attached hydrophobic groups which are capable of hydrophobic associations. The attached "hydrophobic groups" are defined as any chemical group which promotes water insolubility and are typically alkyl or alkaryl groups containing from about 4 to about 30 carbon atoms.

NACOPASEs are structurally based on acrylic carboxylate emulsion polymers. Acrylic carboxylate emulsion polymers are traditionally known for use in a wide variety of thickening applications, including latex coatings, drilling muds, and cosmetics. The acrylic carboxylate emulsion polymers are non-water-soluble, but become soluble in water and thicken when the pH is adjusted from about 6 to about 11.

In this invention, at least a portion of the acrylic carboxylate emulsion polymers of the cleaning composition are non-associative thickeners (containing no hydrophobic groups).

The acrylic carboxylate emulsion polymers which are non-associative thickeners are formed from (1) at least one monoethylenically unsaturated carboxylic acid, (2) at least one $C_1$ to $C_4$ alkyl acrylate or alkyl methacrylate, and optionally (3) one or more polyethylenically unsaturated monomer or a chain transfer agent. Specifically, monomers (1), (2), and (3) for forming the acrylic carboxylate emulsion polymers and their preparation are described in detail in U.S. Pat. No. 5,380,447, incorporated by reference. U.S. Pat. No. 6,297,336 and U.S. Pat. No. 4,423,199, also incorporated by reference, characterizes copolymer acrylic emulsion and methods of production. Structural features of the NACOPASE operable in the present invention are defined in terms of the carboxilic-acid containing monomers from which such polymers and copolymers are derived. Detailed descriptions of the scope of emulsions comprising carboxylic acid copolymers and monomers are found in U.S. Pat. Nos. 3,308,068, 6,635,702, 4,257,907 incorporated by reference.

Various NACOPASEs or mixtures thereof may be employed in the invention so long as they boost the detergency of the cleaning composition without significantly adversely affecting other desired properties of the alkali cleaning composition. In general, the acrylic copolymers which can be employed in the compositions of the present invention can be described as copolymers containing 10 to 70 percent, and preferably 25 to 40 percent by weight of methacrylic acid units and at least 10 percent by weight of units representing an acrylic acid ester of a lower alcohol having from 1 to 4 carbon atoms. The lower acrylate or a mixture thereof may make up the entire balance of the copolymer (i.e., other than methacrylic acid) or a portion of the balance (up to 40 percent by weight of the copolymer) can be derived from one or more neutral monoethylenically unsaturated copolymerizable monomers, methylmethacrylate being preferred. These copolymers and the preparation thereof are described in British Pat. No. 870,994 published Jun. 21, 1961 and Canadian Pat. No. 623,617 issued Jul. 11, 1961, all incorporated by reference. It is stated in those patents that it is essential that the copolymers contain at least 10 percent by weight of a lower acrylate. The presence of the lower alkyl acrylate imparts stability and serves to make the copolymer insoluble in the free acid form yet soluble in alkaline media.

Other NACOPASEs are described in U.S. Pat. No. 4,351,754 (incorporated by refernce). The (meth)acrylic acid copolymer component of the composition, for the sake of convenience, are summarized as follows: The copolymer component is a water insoluble emulsion copolymer of:

(1) acrylic or methacrylic acid (abbreviated "AA" and "MAA," respectively, hereinbelow);

(2) a (meth)acrylic acid ester of a ($C_8$-$C_{24}$) alkyl monoether of a polyethylene glycol having at least two oxyethylene units therein, of the formula (I): $H^2$.C.dbd.C(R)—C(O)—O—($CH_2$—$CH_2$.O)$_n$.—$R^0$ wherein R is H or $CH_3$, the latter being preferred, n is at least 2, and preferably has an average value of at least 10, up to 40 to 60 or even up to 70 or more, and $R^0$ is a hydrophobic group containing at least 8 carbon atoms, e.g., about 8-24 carbon atoms, preferably 12 to 18 carbon atoms or having an average of 12 to 18 or more carbon atoms;

(3) a ($C_1$-$C_4$.alkyl (meth)acrylate, preferably ethyl acrylate (abbreviated "EA" hereinbelow); and (4) optionally, a minor amount, effective for crosslinking, of a polyethylenically unsaturated monomer.

The copolymer component is further characterizable as an alkali soluble and alkali thickenable material meaning, for the purposes of this specification, that addition of an alkali to an aqueous dispersion containing the water insoluble emulsion copolymer (in an amount to at least partially neutralize the copolymer) will dissolve the copolymer and simultaneously cause the copolymer to swell and thereby to thicken the dispersion, in the manner described in British Pat. No. 870,994.

It is to be understood that the NACOPASE component in the compositions of the present invention may be a mixture of various copolymer materials.

The NACOPASE employed in the present invention can be produced by conventional aqueous emulsion polymerization techniques as described in the aforementioned patents. Aqueous dispersions containing from about 20 to about 50 percent solids by weight can be obtained by the emulsion copolymerization and such dispersions are a convenient form in which the copolymers may be employed. Examples of such dispersions are commercially available from Rohm & Haas Company under the trademarks Acrysol.RTM. ASE-60, ASE-75, ASE-95 and ASE-108.

The amount of acrylic copolymer in the compositions of the present invention is from about 1% to about 5% parts by weight, per the combined parts by weight of the other components of the compositions of the invention. Surprisingly, such low amounts were found to boost the detergency of the compositions of the present invention.

The full benefit of enhanced cleaning performance is not realized with amounts much lower than the above-stated lower value. On the other hand, with amounts much higher than the above-stated 6% parts by weight, the consistency of the compositions of the present invention changes and the compositions become thickened. When certain levels are reached, the compositions turns into a gel. The compositions of the present invention employ lower amounts such that the composition in general remain liquid, although the thicker gel forms retain most of the properties of the compositions and may be employed to prepare other germical compositions. A non-limiting example of such germicidal compositions is as follows:

| | |
|---|---|
| Water | 55% to 85% |
| EDTA | 0.5% to 2% |
| Sodium Tripolyphosphate | 2% to 9$ |
| Nonylphenol 9 EO Polyethoxylate | 4% to 15% |
| Diethylene glycol monomethyl ether | 0.5% to 5% |
| ASE-60 | 4% to 10% |
| Opacifier | 0% to 3.0% |
| Quaternary Ammonium Compound | 0% to 3% |

"Alkali soluble emulsions" (ASE)—acrylate (anionic); synthesized from acid and acrylate comonomers. Non-associative ASEs are water soluble/swellable emulsions. ASE polymers are anionic and non-assoicative. The ionic nature and associative ability of the polymers play critical roles in determining the performance characteristics as rheology modifiers. ASE are high molecular weight acrylic rheology modifiers. They are based on homopolymers of (meth) acrylic acid and copolymers of (meth)acrylic acid, (meth) acrylate esters, and maleic acid, among many others. ASE thickeners are rheological additives, recommended for thickening water-based interior/exterior paints, structured water-based paints, coatings, inks, cosmetics, adhesives, tertiary oil recovery; often recommended for reducing turbulence in pumping of aqueous and other liquids.

Suitable NACOPASEs are formed from polycarboxylates which include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

Addition of alkali to the polymer emulsion results in neutralization of the carboxylic acid groups, generating an anionic charge at the acid sites along the polymer chain. The like charges repel one another resulting in swelling and uncoiling of the polymer. This extremely large increase in the hydrodynamic volume of the neutralized ASE polymer, versus the same polymer in its emulsion state, is responsible for a significant build in compound viscosity, at relatively low polymer concentration.

When considering NACOPASES, the relative concentrations and the nature of the different monomers employed in the synthesis can also be readily modified. As such, the variety of available structures, and the flexibility to adapt the polymers to the matrix in which they are used, is almost unlimited.

NON-LIMITING EXAMPLES OF NACOPASES

Carbopol®30

Borchers Additives (e.g. Borchi® Gel ALA (anionic acrylate polymer, thickenrs at pH>8, 10% water) (Lanxess Corp., Pittsburgh, Pa.

Ciba RHEOVIS®ATN

Rohm and Haas: Aculyn® ASE 33; Acrysol® ASE-60; Acrysol® ASE-75; Acrysol® ASE-95; Acrtsik ASE-108 non-associative alkalai soluble emulsions in the Algocum® L-series (National Starch and Chemical Company)

INdofil® ASE-60

UCAR Polyphobe® 106HE (Dow Chemical)

It should be understood that the operable NACOPASEs for use in the present invention are substantially not hydrophobically modified as it is essential that the builder be adequately soluble in water under regular usage conditions. According to this invention extraordinary cleaning results are obtained by using the NACOPASE builder compounds with a wide range of alkali detergent builders. The NACOPASE builder compounds are effective when used singly or as mixtures thereof.

NACOPASEs are used as thickeners in the art. This invention has discovered that a function of NACOPASEs, besides thickening, is improvement in cleaning efficiency. The thickening of the composition of the invention is a secondary use well known in the art. Accordingly, it should be understood that the present invention does not claim the use of NACOPASE as thickeners. Thickeners are used in aqueous systems for a variety of reasons. The enhanced viscosity afforded by a thickener is often necessary in order to reduce flow and to maintain an active agent on a substrate. Typical compositions which utilize thickeners are hand lotions, pharmaceutical preparations, hand and industrial cleansers, and flowable agricultural pesticide formulations. The increased viscosity provided by the thickener may range from slight thickening in moderately flowable systems to generally immobile systems such as gels. In addition to viscosity improvement, many thickeners are pseudoplastic so that an aqueous composition containing the thickener may be blended with other ingredients by agitation. The method of the present invention involving use of NACOPASEs is not directed to thickening, although thickening is achieved.

Adjuvants

Adjuvants and other additive ingredients will vary according to the type of composition being manufactured. Detergent compositions made according to the invention may further include conventional additives such as a water softening agent-, apart from the claimed sequestrant blend, a bleaching agent, alkaline source, secondary hardening agent or solubility modifier, detergent filler, defoamer, anti-redeposition agent, a threshold agent or system, aesthetic enhancing agent (i.e., dye, perfume), and the like.

Adjuvants and other additive ingredients will vary according to the type of composition being manufactured and can be included in the compositions in any amount.

The above processes can be used to produce a product having a stable solution. The compositions can be diluted with aqueous materials to form a use solution of any strength depending on the application. The compositions and diluted use solutions may be useful as, for example, liquid cleaning compositions for use on floors, walls, tile and grout, oven and grill, airport runways, counter tops, running tracks, hard metal surfaces, soft metal surfaces, wood, painted surfaces, garage and automotive maintenance areas, building exteriors (stone, stucco, masonry, aluminum siding, plastic surfaces, glass.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as C1 S-jasmine or jasmal, vanillin, and the like.

In addition to the ingredients already mentioned, the detergents according to the invention may contain other ingredients typical of alkaline detergents: various coloring agents and perfumes; sequestering agents such as ethylene diamine tetraacetates; pearlescing agents and opacifiers; pH modifiers; etc. The proportion of such adjuvant materials, in total will normally not exceed 15% of weight of the detergent composition, and the percentages of most of such individual components will be about 0.1 to 5% by weight and preferably less than about 2% by weight. Sodium bisulfite can be used as a color stabilizer at a concentration of about 0.01 to 0.2 wt. %. Typical perservatives are dibromodicyano-butane, citric acid, benzylic alcohol and poly (hexamethylene-biguamide) hydrochloride and mixtures thereof. Other ingredients can be added to the compositions at concentrations of about 0.1 to 4.0 wt. percent are perfumes, preservatives, color stabilizers, sodium bisulfite, ETDA, and proteins such as lexine protein.

Production of the Composition

A composition of the invention having the formulation shown in Table 1 was produced as follows:

TABLE 1

| COMPOSITION | |
|---|---|
| EDTA | 0.5% to 2% |
| Sodium Tripolyphosphate | 2% to 9% |
| Sodium Hydroxide | 0.5% to 3.0% |
| NP9 ® Nonylphenol and 9 EO polyethoxylate | 4% to 15% |
| diethylene glycol monomethyl ether | 0.5% to 5.0% |
| Acrysol ASE-60 ® | 4% to 10% |
| Water | 55% to 85% |

The following three blends were made:
Blend A - Water, EDTA, sodium tripolyphosphate, sodium hydroxide
Blend B - Surfactant-nonylphenol + 9EO polyethoxylate + diethylene glycol monomethyl-ether
Blend C - ASE-60 (NACOPASE), water Blends A and B were blended together to make blend AB. Blend C was added to make Blend ABC, a hard surface cleaning composition of the invention.

The alkalis were dissolved with water to make Blend A, before adding the surfactant which is premixed together with the glycol ether (Blend B) to have complete dissolution. The final formula is activated at a pH greater than 10.0 but less than 12.0 with Sodium Hydroxide, enough to maintain a stable compound viscosity of 1500 centipoise at 70 degrees F when the polymers are added. ASE-60® is premixed with water to facilitate the incorporation in viscous and alkaline formulation. ASE-60 as the last ingredient, is added slowly to the solution with good agitation to obtain a consistent performance.

An alternative composition involved the addition to Blend ABC of an opacifier (less than 0.1% modified styrne/acrylic polymer).

Formulation ABC has a varying amount of water and can be classified as either a concentrate or ready-to-use composition. These compositions form stable solutions and may be further diluted with water or solvent to any desired strength depending on end use.

Method of Using the Invention

The cleaning composition of the invention can be applied to a hard surface as a concentrate or it can be further diluted with water. Preferably, the detergent composition is applied to the surface or surface material in need of cleaning to provide a soak time or residence time that allows the detergent composition to interact with the soil provided on the surface. Preferably, the soak time or residence time is sufficient to allow the detergent composition to provide a desired level of cleaning. In addition, the detergent composition should be sufficiently active so that the cleaning time is not too long. Preferably, the soak time or residence time is at least about 30 seconds, and more preferably between about one minute and about ten minutes, and, more preferably, between about one minute and about five minutes.

A preferred rinse agent for rinsing the article is water. The detergent composition is preferably applied to a hard surface by spraying, mopping, scrubbing, flooding or other mechanical or manual means of application.

TABLE 2

| | AT 5:1 | AT 100:1 |
|---|---|---|
| EDTA | 0% TO 0.5% | 0% TO 0.5% |
| Sodium Tripolyphosphate | 0.5% TO 3.0% | 0% TO 1.0% |
| Nonylphenol 9EO polyethoxylate | 1.0% to 5.0% | 0% to 1.0% |
| Diethylene glycol monomethyl ether | 0% to 1.0% | 0% to 0.5% |
| Sodium Hydroxide | 0% to 1.0% | 0% to 0.5% |
| ASE-20 | 1.0% to 5.0% | 0% to 1.0% |
| Opacifier | 0% to 1.0% | 0% to 0.5% |
| Water | 80 to 100% | 90% to 100% |

The detergent composition that can be applied to surfaces preferably has the weight percent of components identified in Table 1. It should be understood that the weight percent of each component is expressed based upon 100% active for each active component. Components having an active level of less than 100% can be used although the amount expressed in Table 2 is based upon a 100% active level.

The concentration identified in Table 2 can be further diluted or not further diluted to provide a use solution that is applied to the article surface. A preferred diluent includes water. For a use solution applied directly to a hard surface, it is expected that the use solution will have an active concentration of between about 1% and about 10 wt. %, and, more preferably, between about 0.5 wt. % and about 3 wt. %. It should be understood that the active concentration refers to the concentration of surfactants, builder, chelating agents, and sequestrants provided in the use solution.

Formulation ABC above provides a cleaning solution that can also be used as a dilutable cleaner/degreaser for both food soils and greasy soils and is compatible with all other hard surfaces, and the like. Formulation ABC also exhibits stability in the above concentrate form and when diluted to a use solution.

EXAMPLES OF USE

Baseball Stadium

Property managers found that rubberized floor was not coming clean with their current product. After two weeks of using the composition of the invention (see Table XX), the property managers reported the composition was working well, producing floors that shined without the application of floor finish.

Automobile Dealership

The service bay area floors were covered with 6"×6" light gray, unsealed tiles. These tiles had been subjected to motor oil, transmission oil, ATF, Power Steering fluid, etc. and were not coming clean. The managers had been using both a high alkaline product and a high solvent product but neither was removing the oil from the tiles. The composition of the invention at a 15:1 dilution was poured on the tile and agitated slightly. Immediately, all of the oil came out of the porous tiles, leaving the tiles perfectly clean.

Indoor Running Track

The facilities manager of a gymnasium was having difficulty cleaning an indoor track. The composition of the invention was applied at 15:1 dilution to a small area of the track, agitating briefly with an iron brush. Upon wiping up the created suds, the area beneath the suds was perfectly clean and surround by a dirty floor. Use of the poroduct has expanded to effectively cleaning gym floors, sauna seats, tile, grout, among others.

International Airport

In the mechanics' bathroom, the composition of the invention, the composition of the invention was applied to all hard surfaces. Built up grime was immediately removed. In the mechanics work area, the composition was applied to heavy caked grease, which was immediately cleaned away down to clean concrete. On a runway, a jet fuel spill had sat in the sun baking for several weeks. The composition was applied and it removed the vast majority of the oil spot stain caused by the fuel spill.

EXAMPLES OF OTHER USES

The composition of the invention has been found effective at removing heavy carbonized grease (predominantly proteins) in food service areas, as well as effective cleaning surfaces throughout a kitchen area, from fingerprints on the wall or syrup from a counter or to remove heavy carbon from a grill. The composition of the invention has been found not to erode countertops, and does not discolor or harm plastic, stainless steel or aluminum.

What is claimed is:

1. An aqueous hard surface cleaning composition comprising:

a. a nonassociative, acrylic copolymer alkali swellable emulsion –4% to 10%;

b. a set of alkaline detergent builders comprising sodium hydroxide –0.5% to 3.0%, sodium tripolyphosphate –2% to 9%, and EDTA –0.5% to 2%;

c. nonylphenol polyethoxylate –4% to 15%;

d. diethylene glycol monomethyl ether –0.5% to 5.0%; and e. water –55% to 85%.

2. A method for cleaning a hard surface, comprising the steps of:

a. contacting a hard surface with the aqueous hard surface cleaning composition of claim 1; and b. rinsing the composition from the surface.

3. The method of claim 2 wherein the step of contacting comprises providing the composition with a residence time on the hard surface of between 30 seconds and 10 minutes.

4. A method of cleaning a hard surface comprising the steps of a. providing the hard surface with the aqueous hard surface cleaning composition of claim 1;

b. diluting at least a portion of the composition to create a use solution; and contacting the hard surface with the use solution.

* * * * *